United States Patent [19]

Stahl

[11] Patent Number: 4,599,761

[45] Date of Patent: Jul. 15, 1986

[54] POLISHING DISK

[76] Inventor: Helmut Stahl, Bergle 5, 7205 Böttingen, Fed. Rep. of Germany

[21] Appl. No.: 689,066

[22] Filed: Jan. 7, 1985

[51] Int. Cl.[4] ..... B24B 29/00

[52] U.S. Cl. ..... 15/230.12; 15/230.15

[58] Field of Search ..... 15/230, 230.12–230.19, 15/97 R, 97 A

[56] References Cited

U.S. PATENT DOCUMENTS

| | | | |
|---|---|---|---|
| 1,475,074 | 11/1923 | McLaughlin | 15/230 X |
| 2,090,814 | 8/1937 | Seybert | 15/230.14 |
| 3,438,080 | 4/1969 | Atkins | 15/230.13 |

FOREIGN PATENT DOCUMENTS

| | | | |
|---|---|---|---|
| 1037913 | 8/1958 | Fed. Rep. of Germany | 15/230.13 |
| 356034 | 9/1961 | Switzerland | 15/230.14 |
| 419888 | 3/1967 | Switzerland | 15/230.17 |
| 786662 | 11/1957 | United Kingdom | 15/230.17 |
| 906510 | 9/1962 | United Kingdom | 15/230 |

*Primary Examiner*—Edward L. Roberts
*Attorney, Agent, or Firm*—Erwin S. Teltscher

[57] ABSTRACT

A polishing disk or polishing roller includes a rigid carrier ring and a yieldable layer of textile material attached to the circumference of the carrier ring. So as to permit smooth polishing of a workpiece free of any smudges or smears, the yieldable layer consists of a plurality of single threads distributed over the periphery of the carrier ring; when the carrier ring is rapidly rotated, the threads extend with their free outer ends,—which preferably have a length from 30 to 50 cm,—substantially radially outwards under the action of the centrifugal force. The polishing disk is provided with border rings of textile material on its lateral ends; each border ring is separated by radial slits into single and mutually overlapping segments of textile material.

12 Claims, 2 Drawing Figures

POLISHING DISK

CROSS REFERENCES TO RELATED APPLICATIONS AND PUBLICATIONS

Concurrently filed application "Machine equipped with a grinding band".

FIELD OF THE INVENTION

The present invention relates to a polishing disk or a polishing roller having a rigid carrier ring and a yieldable layer of textile material secured to the periphery of the carrying ring.

BACKGROUND OF THE INVENTION

Polishing disks or polishing rollers of this type are intended for use in polishing machines or buffing machines, where the polishing disks or polishing rollers are made to rotate rapidly for the polishing, lapping, or smoothing of the surface of preformed work pieces, and where the polishing disks are provided at their free peripheral surface with polishing means or smoothing means. The yieldable layer of the polishing disk consists perponderantly of textile material layers in the form of a fabric rolled around the disk periphery, and wherein the layers of fabric are either loose or stitched to one another. For the smoothing operation fabrics of wool or cotton of the finest consistency are primarily used, which, in turn, are to match the contours of the work to be processed as closely as possible.

It has been shown, however, that even the fabrics of the finest consistency exert a pressure on the surface of the work, due to cross-threads being contained therein, which renders a polishing free of any smears or shadows more difficult, or practically impossible. Furthermore, it is not easily possible to polish complicated surfaces having narrow concave grooves or pockets in a uniform manner by means of polishing disks of the prior art, or to smooth the surfaces in such a fashion as to be free of any smears or traces.

SUMMARY OF THE INVENTION

It is therefore an object of the present invention to furnish a polishing disk or a polishing roller, which permits smoothing of the work surfaces free of any smears or shadows, even if the surfaces are formed in a complicated manner.

This object is attained by the yieldable layer attached to a rigid carrier ring of the polishing disk consisting of a multiplicity of individual threads distributed over the periphery of the carrier ring, and wherein each thread has a free end of a length of at least 10 cm. The free ends extend substantially radially outwards, when acted upon by a centrifugal force, which arises when the carrier is rapidly rotated. The free ends of the threads are adapted to impinge on the surface of the workpiece, and to roll off therefrom.

The invention starts from the thought that a smudge-free smoothing of even complicated surfaces is only possible if the particles contained in the grinding paste can penetrate uniformly into the deepest recesses of the surfaces of the work, namely if a uniformly remaining impact level is maintained without exerting any local pressure, and wherein that impact level may optionally be controllable by the number of revolutions of the polishing disk. This is attained by the inventive feature of the individual threads impacting, not with their end points, but along their lengths in a whip-like manner onto the surface of the work, and rolling off therefrom upon the disk being further rotated. The threads therefore actually yield to any pressure, so that any pressure intensities cannot be added, as is the case with polishing disks made of layers of fabric.

Furthermore any heat developed during the polishing process is much lower than has been the case hitherto, so that threads having components made of synthetic fibers can be used, which in turn insures a long life. The proportion of synthetic fiber-repelling particles, for example of polyester fibers, can therefore steadily increase in an axial direction from one side of the disk to the other. By this means it is possible to initially free the surface of the work piece during the course of the smoothing process from any coarse contaminations or any uneveness by simply sliding it through the periphally attached fibers of the polishing disk along an axial direction, and the work can be polished to a high gloss, as the proportion of synthetic fibers increases along the threads.

According to a preferred embodiment of the invention, the individual threads driven outwardly as the result of the centrifugal force, have a length of 30–50 cm, have a thickness of 0.02 to 1 mm, and result in a density of threads along the peripheral surface of from 10–100 threads per $cm^2$.

So as to maintain the free ends of the threads even in the case of a stationary polishing disk and during transport in a certain axial region, the polishing disk may be provided on its frontal surfaces with bordering rings of textile material, which are separated by radial slits or cuts into individual and mutually overlapping material segments. During operation the bordering rings have the additional object to stabilize the air stream within the region of the polishing disk, so as to maintain any axial spreading of the layer of threads within limits.

The novel features which are considered as characteristic of the invention are set farth in particular in the appended claims. The invention itself, however, both as to its construction and method of operation, together with additional objects and advantages thereof, will best be understood from the following description of the specific embodiments read in connection with the accompanying drawings.

DESCRIPTION OF THE PREFERRED EMBODIMENTS

Figure 1:
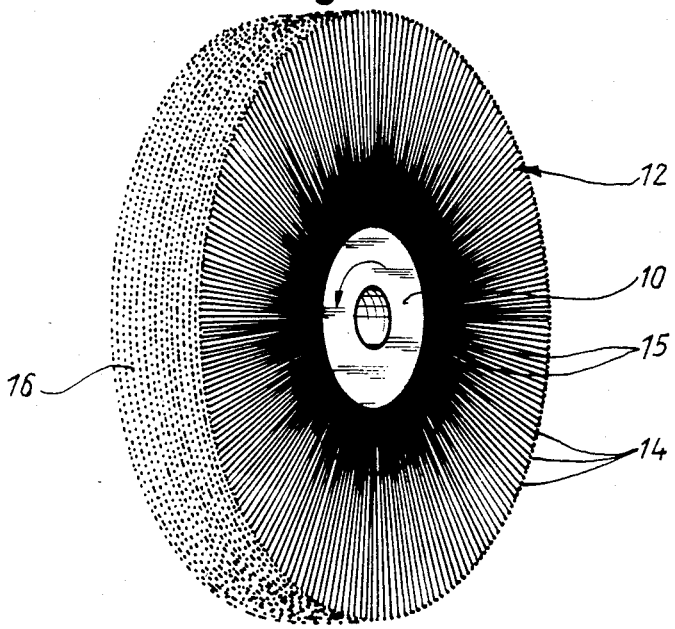
FIG. 1 is a perspective view of the polishing disk, according to the present invention, having a yieldable layer composed of individual threads.

Each polishing disk shown in the drawing consists of a rigid carrier ring 10, and a yieldable layer 12 affixed to the periphery of the carrier ring; the yieldable layer 12 contains a multiplicity of individual threads 14 distributed along the periphery of the carrier ring. When the polishing disk is rotating rapidly, the individual threads are subjected to the action of the centrifugal force in such a manner that their free ends substantially extend radially outwardly. At their ends facing the carrier ring 10 the individual threads 14 are connected to one another by means of a wrap-around spiral-, or annular-band 15, while forming non-illustrated thread layers which have a thickness of about 10 mm. Several of these thread layers are secured to the surface of the carrier ring, while being spaced at respective axial distances of about 20 mm from one another, for example they may be glued or may be stitched to the carrier ring. So as to ensure a secure attachment to the surface of the carrier ring, the ends of the threads facing the carrier ring are wound onto the surface of the carrier ring along a peripheral direction, before they are connected thereto.

During rapid rotation of the polishing disk the long free ends of the threads having a length of at least 10 mm, but preferably 30–50 mm, are driven by the centrifugal force outwardly to such an extent, that in spite of the thread layers being spaced from one another, they form a peripheral surface 16 having an approximately uniform thread density of about 10 to 100 threads per $cm^2$. The twisted singular threads 14, depending on their use, have therefore a diameter from about 0.02 mm to about 1 mm, and following extended use, expand in a brush-like manner at their free ends. A fiber mixture of 60–90% cotton or wool, and of 40–10% of synthetic fibers, particularly polyester fibers, is preferred as a fiber mixture.

Figure 2:
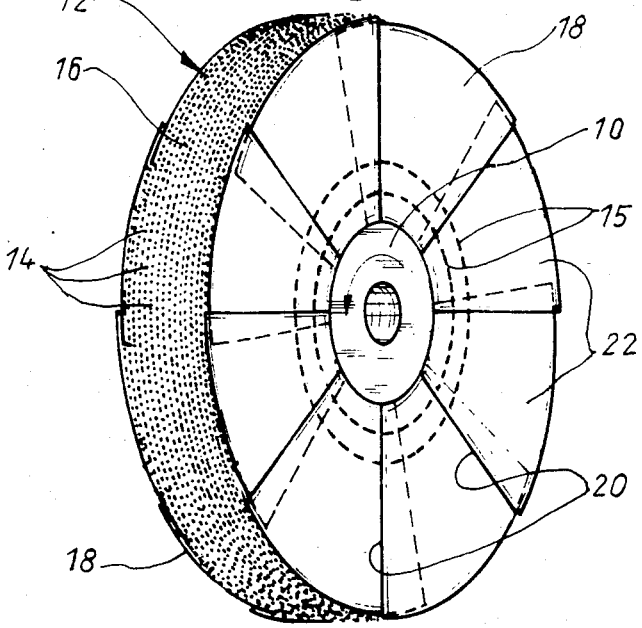
FIG. 2 is a perspective view of the polishing disk according to FIG. 1, but having border rings disposed on each side of the disk.

In the embodiment example shown in FIG. 2, the polishing disk is provided on its lateral end surfaces with bordering rings 18 of textile material, which, in turn, are separated by radial slits 20 into single mutually overlapping textile material segments 22.

While the invention has been illustrated in preferred embodiments, it is not to be limited to the structures shown, since many variations thereof will be evident to one skilled in the art and are intended to be encompassed in the present invention as set forth in the following claims.

I claim:

1. A polishing disk comprising a rigid carrier ring; and a yieldable layer of textile material attached to the periphery of the carrier ring, said yieldable layer including a multiplicity of individual threads distributed over the periphery of said carrier ring, each thread having a diameter in the range from about 0.02 mm to about 1 mm, and a free end of a length of at least 10 cm, said individual threads including a proportion of particle-repelling synthetic fibers including polyester fibers, the remaining individual threads containing cotton or wool, and wherein the proportion of synthetic fibers in respective individual threads steadily increases from one side of the disk to another side of the disk, said free ends extending substantially radially outwardly when acted upon by a centrifugal force, said centrifugal force arising from said carrier ring being rapidly rotated, the free ends of said threads being adapted to impinge on the surface of a workpiece, and to roll off therefrom, and wherein, upon the disk being rotated, the workpiece is adapted to enter one side of the disk, to pass through said yieldable layer, and to exit from the other side of said disk.

2. The polishing disk as set forth in claim 1, wherein said free ends of the threads have a length from about 30 cm to about 40 cm.

3. The polishing disk as set forth in claim 1, wherein said individual threads include multifilar twined threads.

4. The polishing disk as set forth in claim 1, wherein the fiber density at a region of the outwardly facing thread ends acted upon by the centrifugal force is between 10 to 100 per $cm^2$.

5. The polishing disk as set forth in claim 1, wherein said individual threads are twined and are expanded at their free ends in a brush-like manner.

6. The polishing disk as set forth in claim 1, further comprising border rings disposed on respective end surfaces thereof, said border rings being made of textile material.

7. The polishing disk as set forth in claim 6, wherein each border ring is subdivided into a plurality of mutually overlapping segments separated from one another by respective radial slits.

8. The polishing disk as set forth in claim 1, wherein the proportion of said synthetic fibers is less than 20% on said one side of said disk and more than 50% on said other side thereof.

9. The polishing disk as set forth in claim 1, wherein the proportion of cotton or wool in said individual threads is 60% to 90%, and wherein the proportion of the sythentic fibers in said individual threads is 40% to 10%.

10. The polishing disk as set forth in claim 1, further comprising attachment means for securing the respective ends of said threads to the surface of said carrier ring.

11. The polishing disk as set forth in claim 10, wherein said attachment means include glue for glueing said respective ends of said individual threads to the surface of said carrier ring.

12. The polishing disk as set forth in claim 10, wherein said attachment means include stitches for stitching said respective ends of said individual threads to the surface of said carrier ring.

* * * * *